US012359828B2

(12) United States Patent
Liebendorfer et al.

(10) Patent No.: US 12,359,828 B2
(45) Date of Patent: Jul. 15, 2025

(54) LOW CHARGE PACKAGED AMMONIA REFRIGERATION SYSTEM WITH EVAPORATIVE CONDENSER

(71) Applicant: Evapco, Inc., Taneytown, MD (US)

(72) Inventors: Kurt L. Liebendorfer, Taneytown, MD (US); Gregory S. Derosier, Eldersburg, MD (US); Trevor Hegg, Westminster, MD (US); Sarah L. Ferrari, Mount Airy, MD (US); Don Hamilton, Taneytown, MD (US); Nicholas Hesser, Taneytown, MD (US); Kenneth Wright, Taneytown, MD (US)

(73) Assignee: Evapco, Inc., Taneytown, MD (US)

( * ) Notice: Subject to any disclaimer, the term of this patent is extended or adjusted under 35 U.S.C. 154(b) by 0 days.

(21) Appl. No.: 18/426,556

(22) Filed: Jan. 30, 2024

(65) Prior Publication Data

US 2024/0288183 A1 Aug. 29, 2024

Related U.S. Application Data

(62) Division of application No. 17/348,042, filed on Jun. 15, 2021, now Pat. No. 11,885,513, which is a (Continued)

(51) Int. Cl.
*F24F 1/46* (2011.01)
*F25B 5/02* (2006.01)
(Continued)

(52) U.S. Cl.
CPC ..... *F24F 1/46* (2013.01); *F25B 9/002* (2013.01); *F25B 39/028* (2013.01); *F25B 39/04* (2013.01);
(Continued)

(58) Field of Classification Search
CPC .. F24F 1/46; F25B 41/39; F25B 9/002; F25B 39/028; F25B 39/04; F25B 43/00; F25B 43/0006; F25B 49/005; F25B 5/02; F25B 2339/041; F25B 2400/05; F25B 2400/071; F25B 2400/13; F25B 2400/23; F25B 2500/17; F25B 2700/13; F25B 2700/1351; F25B 2700/19; F25B 2700/21175; F25D 23/006
(Continued)

(56) References Cited

U.S. PATENT DOCUMENTS 6,009,715 A * 1/2000 Sakurai ..... F25B 39/04 62/505
6,070,426 A * 6/2000 Sakashita ..... F28D 5/00 62/428
(Continued)

*Primary Examiner* — Joel M Attey
(74) *Attorney, Agent, or Firm* — Whiteford, Taylor & Preston, LLP; Peter J. Davis

(57) ABSTRACT

A packaged, pumped liquid, evaporative-condensing recirculating ammonia refrigeration system with charges of 10 lbs or less of refrigerant per ton of refrigeration capacity. The compressor and related components are situated inside the plenum of a standard evaporative condenser unit, and the evaporator is close coupled to the evaporative condenser. Single or dual phase cyclonic separators may also be housed in the plenum of the evaporative condenser.

17 Claims, 17 Drawing Sheets

Related U.S. Application Data division of application No. 15/839,484, filed on Dec. 12, 2017, now Pat. No. 11,035,594.

(60) Provisional application No. 62/432,883, filed on Dec. 12, 2016.

(51) Int. Cl.

| | |
|---|---|
| ***F25B 9/00*** | (2006.01) |
| ***F25B 39/02*** | (2006.01) |
| ***F25B 39/04*** | (2006.01) |
| ***F25B 41/39*** | (2021.01) |
| ***F25B 43/00*** | (2006.01) |
| ***F25B 49/00*** | (2006.01) |
| ***F25D 23/00*** | (2006.01) |

(52) U.S. Cl.

CPC ..... *F25B 41/39* (2021.01); *F25B 43/00* (2013.01); *F25B 49/005* (2013.01); *F25D 23/006* (2013.01); *F25B 5/02* (2013.01); *F25B 43/006* (2013.01); *F25B 2339/041* (2013.01); *F25B 2400/05* (2013.01); *F25B 2400/071* (2013.01); *F25B 2400/13* (2013.01); *F25B 2400/23* (2013.01); *F25B 2500/17* (2013.01); *F25B 2700/13* (2013.01); *F25B 2700/1351* (2013.01); *F25B 2700/19* (2013.01); *F25B 2700/21175* (2013.01)

(58) Field of Classification Search

USPC ..... 62/119

See application file for complete search history.

(56) References Cited

U.S. PATENT DOCUMENTS

| | | | | |
|---|---|---|---|---|
| 7,021,070 | B2 * | 4/2006 | Jensen | F28D 5/00 62/506 |
| 2013/0213068 | A1 * | 8/2013 | Goel | F25B 49/005 29/890.035 |

* cited by examiner

25 TR FREEZER UNIT

- RECIRCULATED TOP FEED 1.2:1
- CYCLONE SEPARATION
- GLYCOL DEFROST
- CONVENTIONAL OIL SEPARATION
- EXTERNAL OIL COOLING IN CONDENSER
- FLASH ECONOMIZED
- CHARGE KEPT IN ECONOMIZER
- ADIABATIC MATS ON CONDENSER

| **LEGEND** | |
|---|---|
| AD | AMMONIA DETECTOR |
| COR | COMPRESSOR OIL RETURN |
| COS | COMPRESSOR OIL SUPPLY |
| CV | CONTROL VALUE |
| DRN | DRAIN |
| FX | FLEX CONNECTION |
| GLS | GLYCOL LIQUID SUPPLY |
| GLR | GLYCOL LIQUID RETURN |
| HV | HAND ISOLATION VALVE |
| HT | HUMIDITY TRANSMITTER |
| IPV | INTERMEDIATE PRESSURE VAPOR |
| HPV | HIGH PRESSURE VAPOR |
| LPV | LOW PRESSURE VAPOR |
| LPL | LOW PRESSURE PUMPED LIQUID |
| OS | COMPRESSOR OIL SYSTEM |
| PSV | PRESSURE SAFETY VALVE |
| PI | PRESSURE INDICATOR (GAGE) |
| PT | PRESSURE TRANSMITTER |
| RLF | RELIEF |
| ST | STRAINER |
| TI | TEMPERATE INDICATOR |
| TT | TEMPERATURE TRANSMITTER |
| TW | TEMPERATURE WELL |

FIG 2.

- Solutions include single modules and two separate modules
- Facilitates Split System Design

MACHINE ROOM MODULE

- Completely piped, wired, tested & insulated
  - 95% of all piping is Stainless Steel
- Provides Required Machine Room:
  - Maintenance access
  - Ammonia detection
  - Safety controls
  - Safety relief system
  - Ventilation
- Microprocessor control system for entire unit
- Insulated "Superfloor", directly on refrigerated space

[redacted]

Integrated Evaporative Condensing Chiller Package

LOW CHARGE PACKAGED AMMONIA REFRIGERATION SYSTEM WITH EVAPORATIVE CONDENSER

FIELD OF THE INVENTION

The present invention relates to industrial refrigeration systems.

BACKGROUND OF THE INVENTION

Prior art industrial refrigeration systems, e.g., for refrigerated warehouses, especially ammonia based refrigeration systems, are highly compartmentalized. The evaporator coils are often ceiling mounted in the refrigerated space or collected in a penthouse on the roof of the refrigerated space, the condenser coils and fans are usually mounted in a separate space on the roof of the building containing the refrigerated space, and the compressor, receiver tank(s), oil separator tank(s), and other mechanical systems are usually collected in a separate mechanical room away from public spaces. Ammonia-based industrial refrigeration systems containing large quantities of ammonia are highly regulated due to the toxicity of ammonia to humans, the impact of releases caused by human error or mechanical integrity, and the threat of terrorism. Systems containing more than 10,000 lbs of ammonia require EPA's Risk Management Plan (RMP) and OSHA's Process Safety Management Plan and will likely result in inspections from federal agencies. California has additional restrictions/requirements for systems containing more than 500 lbs of ammonia. Any refrigeration system leak resulting in the discharge of 100 lbs or more of ammonia must be reported to the EPA.

SUMMARY OF THE INVENTION

The present invention is a packaged, pumped liquid, recirculating refrigeration system with charges of 10 lbs or less of refrigerant per ton of refrigeration capacity. The present invention is a low charge packaged refrigeration system in which the compressor and related components are situated in a pre-packaged modular machine room, and in which the condenser is close coupled to the pre-packaged modular machine room. According to an embodiment of the invention, the prior art large receiver vessels, which are used to separate refrigerant vapor and refrigerant liquid coming off the evaporators and to store backup refrigerant liquid, may be replaced with liquid-vapor separation structure/device which is housed in the pre-packaged modular machine room. According to one embodiment, the liquid-vapor separation structure/device may be a single or dual phase cyclonic separator. According to another embodiment of the invention, the standard economizer vessel (which collects liquid coming off the condenser) can also optionally be replaced with a single or dual phase cyclonic separator, also housed in the pre-packaged modular machine room. The evaporator coil tubes are preferably formed with internal enhancements that improve the flow of the refrigerant liquid through the tubes, enhance heat exchange and reduce refrigerant charge. According to one embodiment, the condenser may be constructed of coil tubes preferably formed with internal enhancements that improve the flow of the refrigerant vapor through the tubes, enhance heat exchange and reduce refrigerant. According to a more preferred embodiment, the evaporator tube enhancements and the condenser tube enhancements are different from one-another. The specification of provisional application Ser. No. 62/188,264 entitled "Internally Enhanced Tubes for Coil Products" is incorporated herein in its entirety. According to an alternative embodiment, the condenser system may employ microchannel heat exchanger technology. The condenser system may be of any type known in the art for condensing refrigerant vapor into liquid refrigerant.

According to various embodiments, the system may be a liquid overfeed system, or a direct expansion system, but a very low charge or "critically charged" system is most preferred with an overfeed rate (the ratio of liquid refrigerant mass flow rate entering the evaporator versus the mass flow rate of vapor required to produce the cooling effect) of 1.05:1.0 to 1.8:1.0, and a preferred overfeed rate of 1.2:1. In order to maintain such a low overfeed rate, capacitance sensors, such as those described in U.S. patent application Ser. Nos. 14/221,694 and 14/705,781 the entirety of each of which is incorporated herein by reference, may be provided at various points in the system to determine the relative amounts of liquid and vapor so that the system may be adjusted accordingly. Such sensors are preferably located at the inlet to the liquid-vapor separation device and/or at the outlet of the evaporator, and/or someplace in the refrigerant line between the outlet of the evaporator and the liquid-vapor separation device and/or at the inlet to the compressor and/or someplace in the refrigerant line between the vapor outlet of the liquid-vapor separation device and the compressor.

Additionally, the condenser system and the machine room are preferably close-coupled to the evaporators. In the case of a penthouse evaporator arrangement, in which evaporators are situated in a "penthouse" room above the refrigerated space, the machine room is preferably connected to a pre-fabricated penthouse evaporator module. In the case of ceiling mounted evaporators in the refrigerated space, the integrated condenser system and modular machine room are mounted on a floor or rooftop directly above the evaporator units (a so-called "split system").

According to a further embodiment, the compressor and related components may be situated inside the plenum of an evaporative condenser and the coil of the evaporative condenser is close coupled to the compressor and other components of the chiller package. Specifically, according to this embodiment, underutilized space in the plenum of a standard or modified prior art evaporative condenser is used to house the remaining components of the chiller package, with the evaporator located in the refrigerated space or in an evaporator module preferably adjacent to the integrated evaporative condenser/chiller package. According to this embodiment, the system may use an induced draft co-flow condenser coil with crossflow fill. The air enters on one long side of the package through the fill media and at the top of the coil. The balance of the chiller package is housed within the condenser plenum with the sump located below. An additional benefit of this integrated arrangement is that it may allow reach-in, rather than walk-in, access to chiller service items.

According to an alternate embodiment of the invention, there may be presented induced draft evaporative condenser arrangement which may replace the fill media with a larger condensing coil extending across the plan area. In this embodiment, the air and water would be in a counterflow arrangement through the evaporative condensing coil. The induced draft arrangement allows ambient air to enter below the coil on all sides, including through the chiller area, as long as that area is not enclosed, though the chiller components must be isolated from the falling spray water.

According to still further embodiments, forced draft units with either axial or centrifugal fans are presented. According to these evaporative condensing with forced draft axial or centrifugal fan embodiments, the fans would blow air into the unit from one long side of the condenser. A wall between the chiller package and the plenum is required to turn the air, directing it upward through the coil.

The combination of features as described herein provides a very low charge refrigeration system compared to the prior art. Specifically, the present invention is configured to require less than six pounds of ammonia per ton of refrigeration capacity. According to a preferred embodiment, the present invention can require less than four pounds of ammonia per ton of refrigeration. And according to most preferred embodiments, the present invention can operate efficiently with less than two pound per ton of refrigeration capacity. By comparison, prior art "stick-built" systems require 15-25 pounds of ammonia per ton of refrigeration, and prior art low charge systems require approximately 10 pounds per ton of refrigeration. Thus, for a 50 ton refrigeration system, prior art stick built systems require 750-1,250 pounds of ammonia, prior art low charge systems require approximately 500 pounds of ammonia, and the present invention requires less than 300 pounds of ammonia, and preferably less than 200 pounds of ammonia, and more preferably less than 100 pounds of ammonia, the report threshold for the EPA (assuming all of the ammonia in the system were to leak out). Indeed according to a 50 ton refrigeration system of the present invention, the entire amount of ammonia in the system could be discharged into the surrounding area without significant damage or harm to humans or the environment.

DESCRIPTION OF THE DRAWINGS

FIG. 2 is a blow-up of the upper left hand portion of FIG. 1.

DETAILED DESCRIPTION OF THE INVENTION

Figure 1:
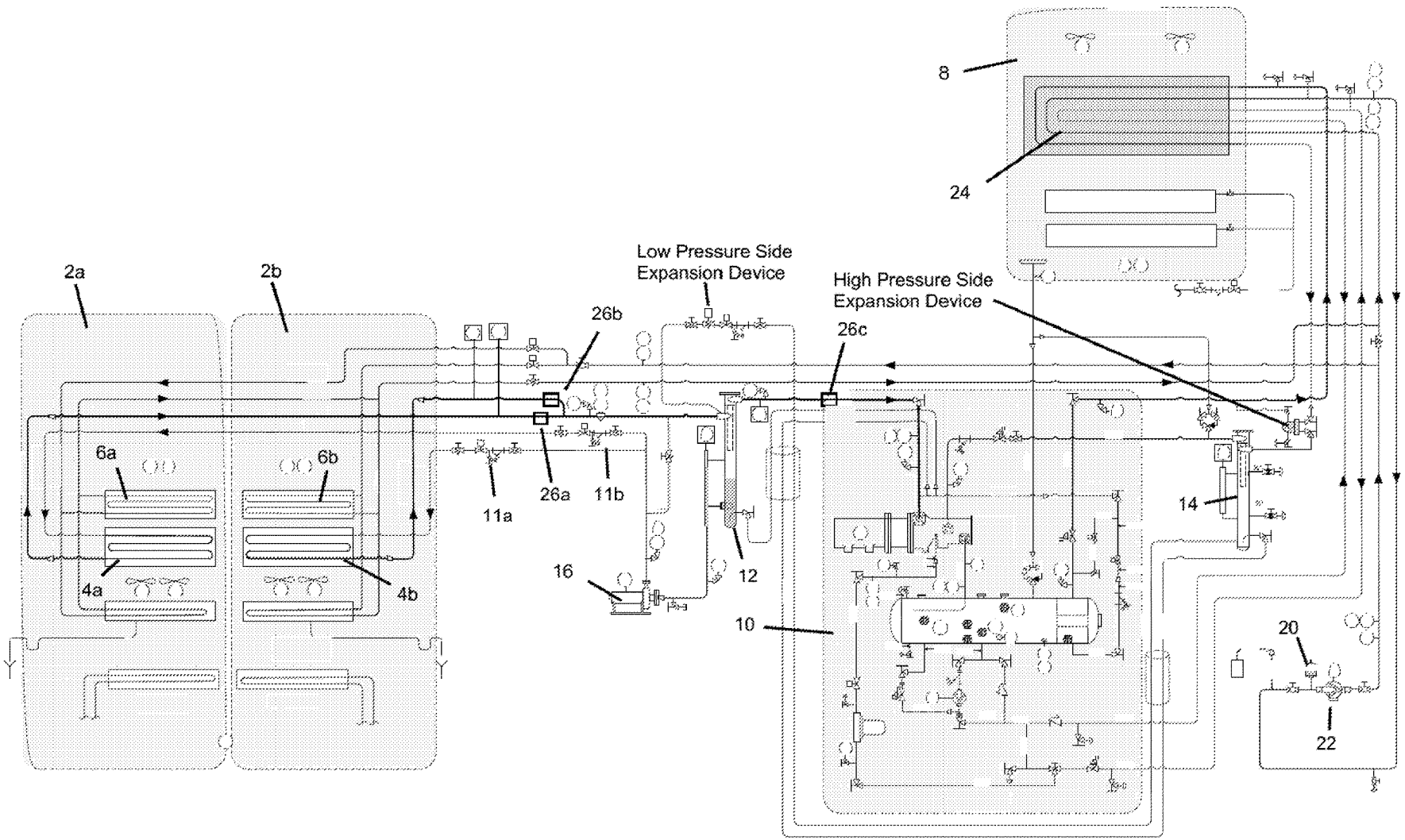
FIG. 1 is a schematic of a refrigeration system according to an embodiment of the invention.
Figure 3A:
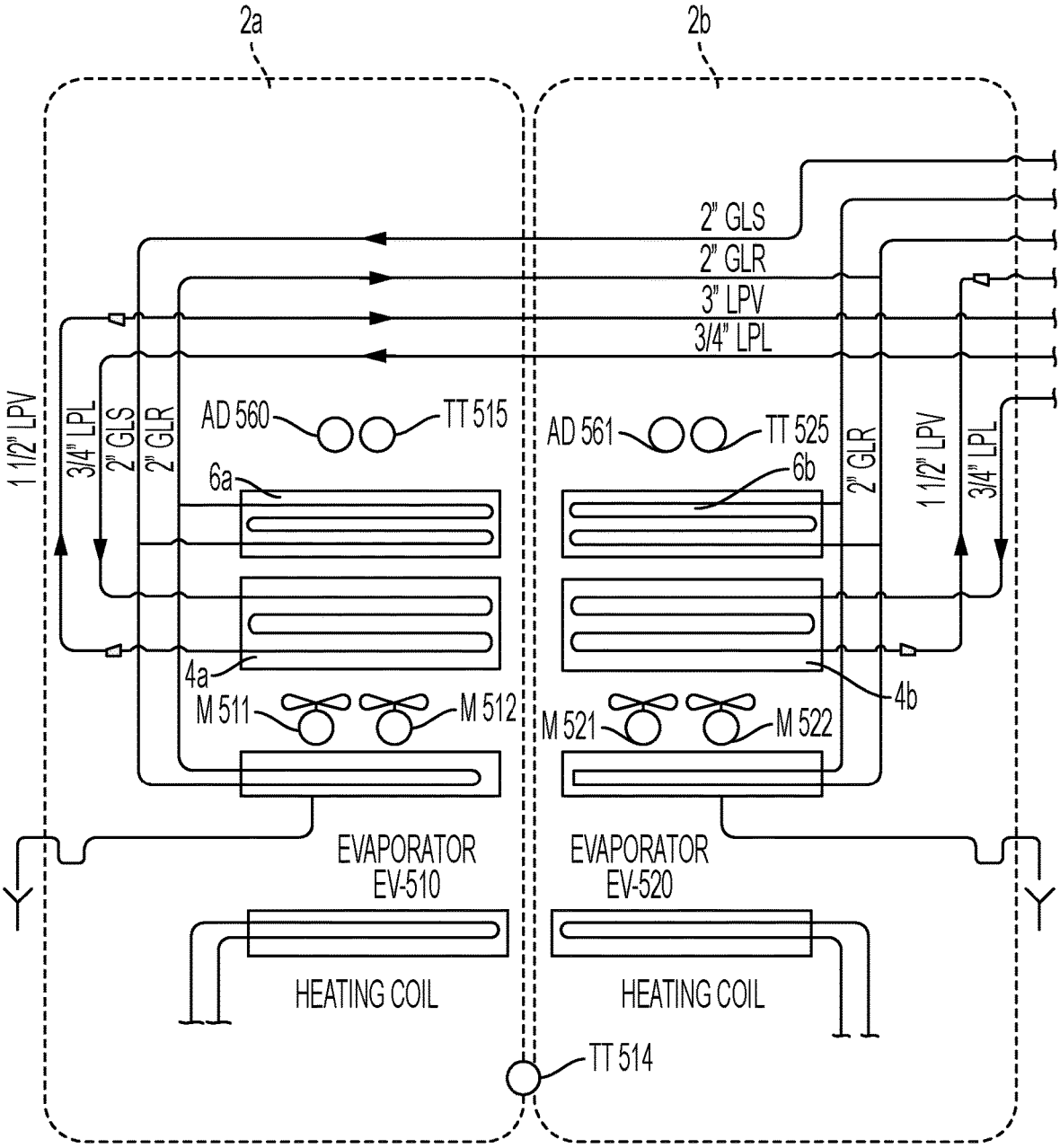
FIG. 3A is a blow-up of the lower left hand portion of FIG. 1.
Figure 3B:
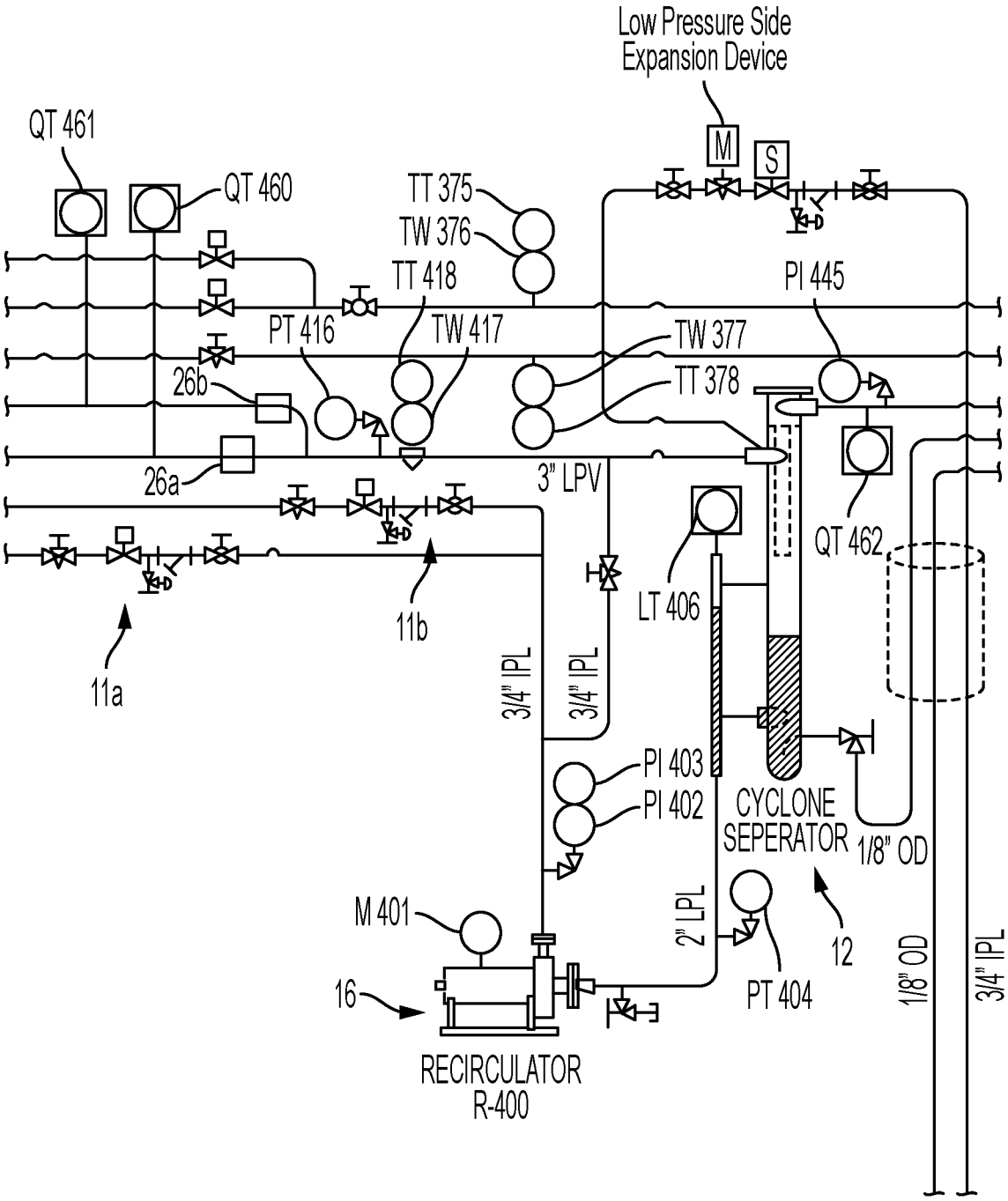
FIG. 3B is a blow-up of the lower left hand portion of FIG. 1.
Figure 4A:
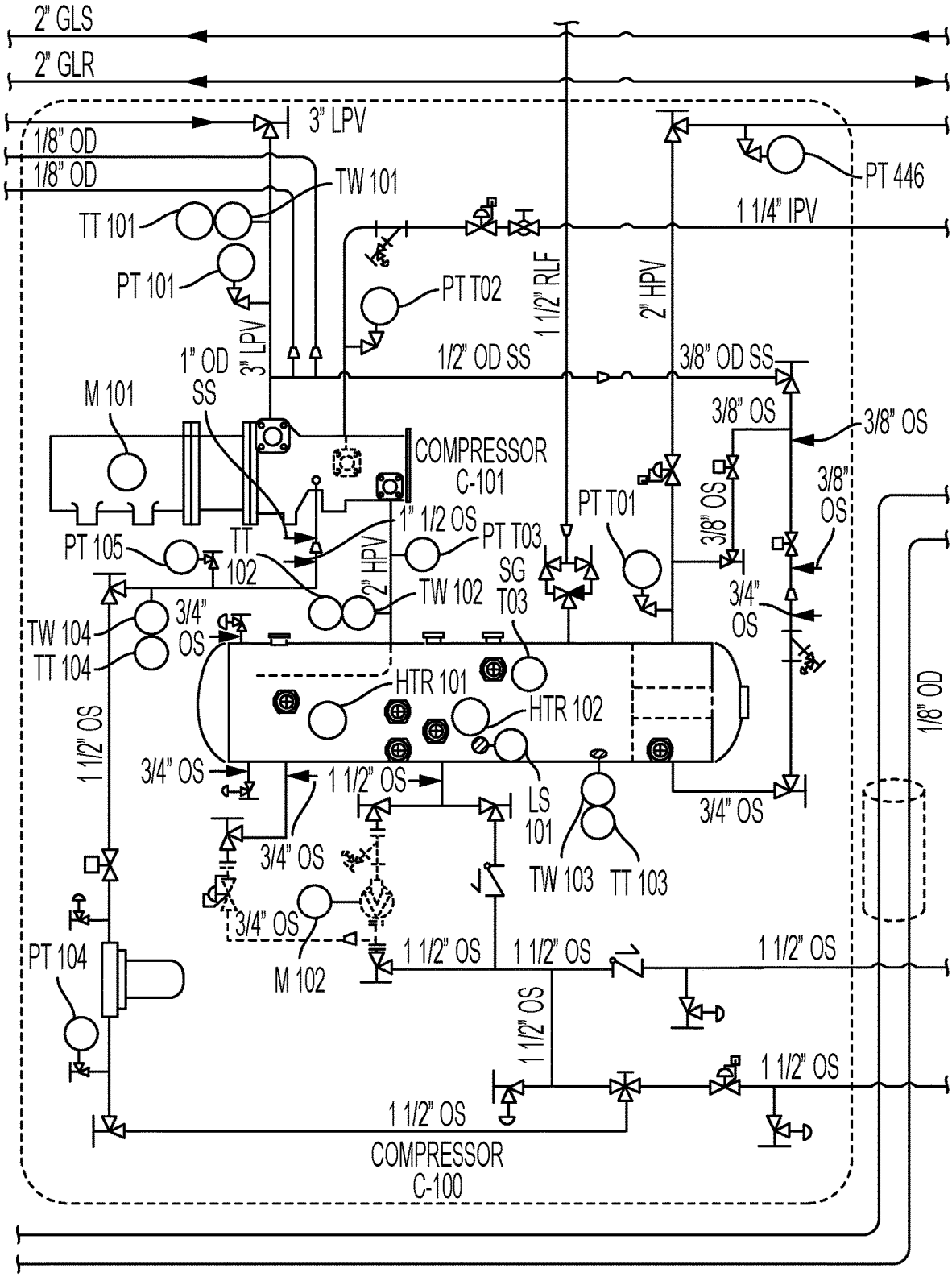
FIG. 4A is a blow-up of the lower right hand portion of FIG. 1.
Figure 4B:
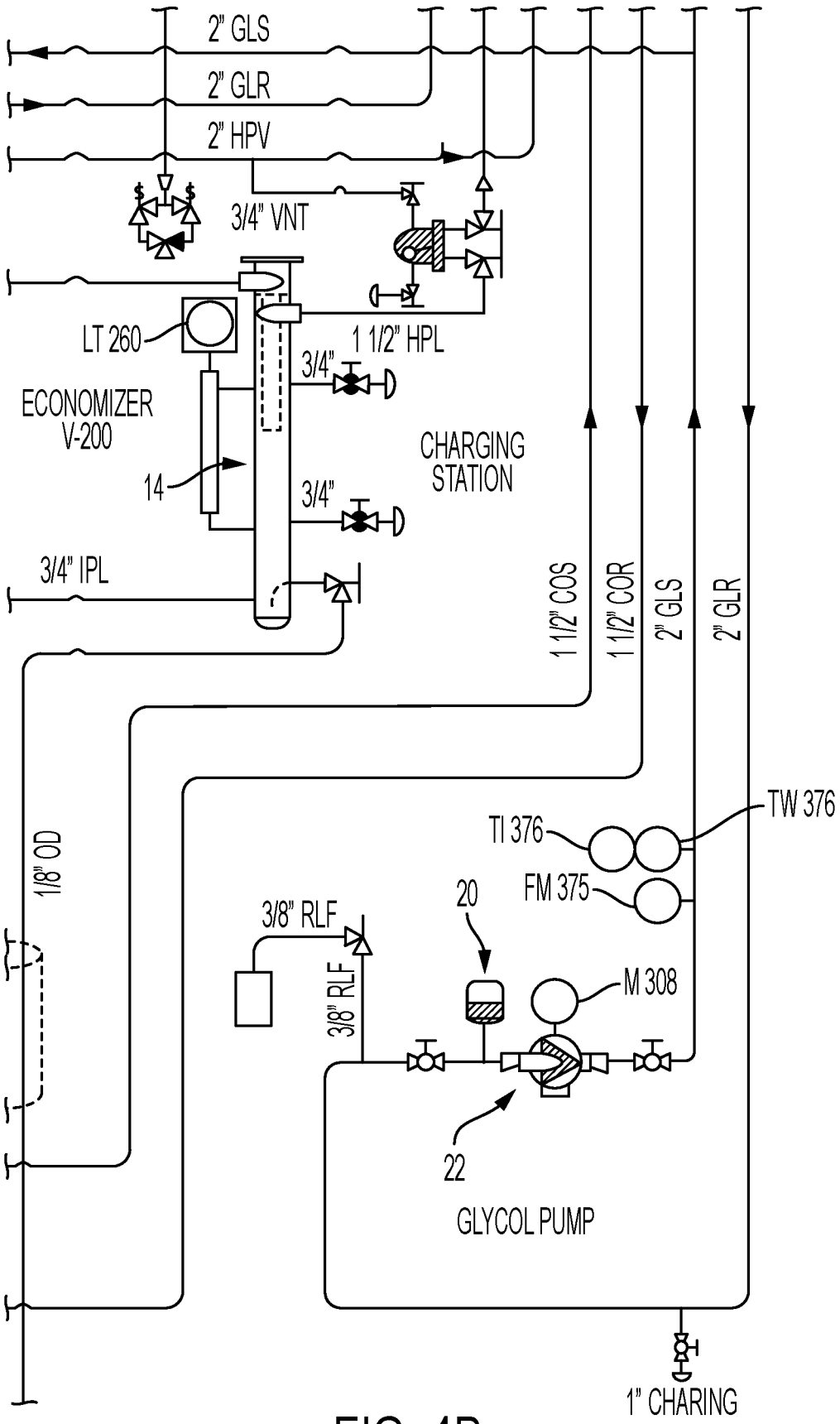
FIG. 4B is a blow-up of the lower right hand portion of FIG. 1.
Figure 5:
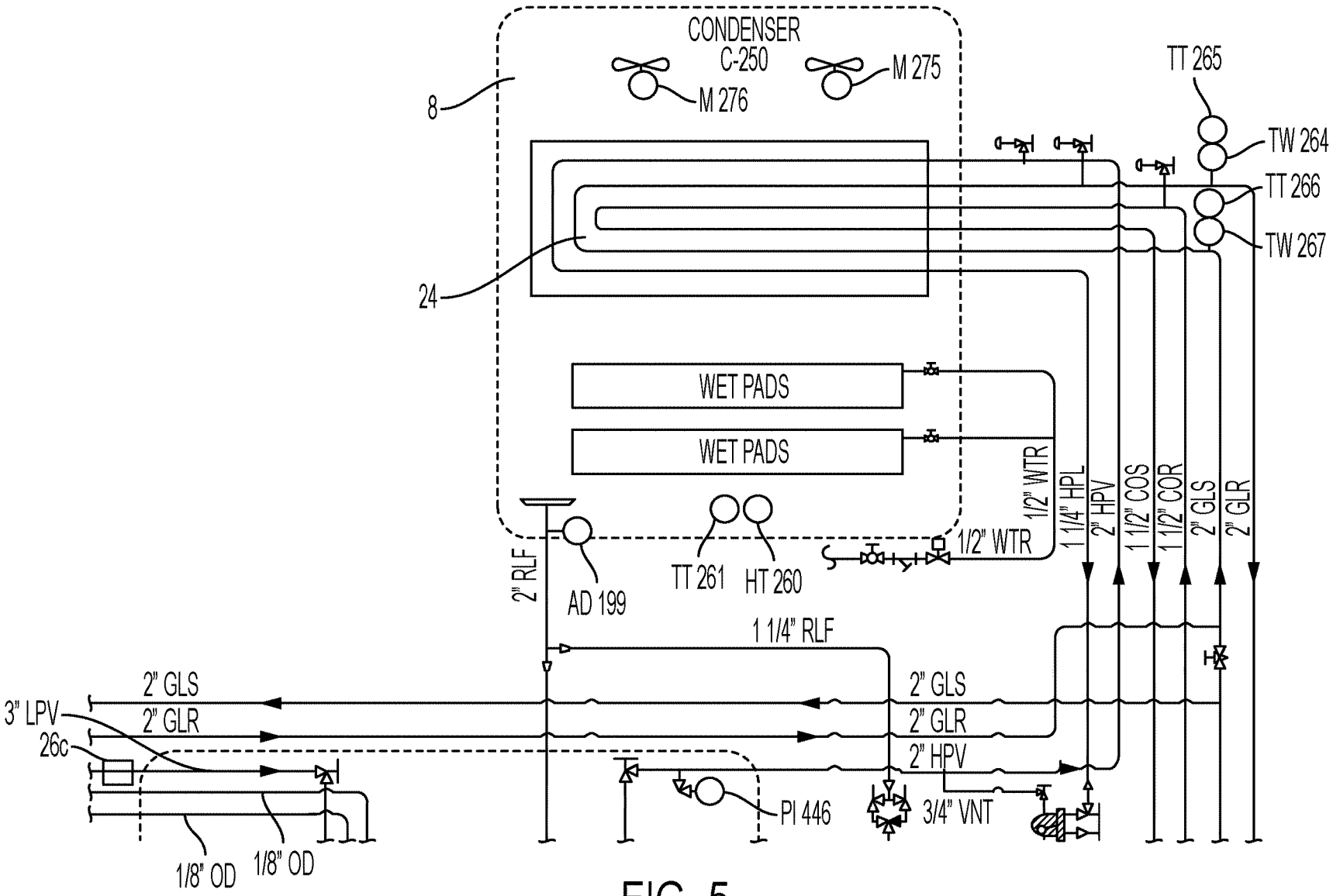
FIG. 5 is a blow up of the upper right hand portion of FIG. 1.

FIG. 1 is a process and instrumentation diagram for a low charge packaged refrigeration system according to an embodiment of the invention. Blow-ups of the four quadrants of FIG. 1 are presented in FIGS. 2 through 5, respectively. The system includes evaporators 2*a* and 2*b*, including evaporator coils 4*a* and 4*b*, respectively, condenser 8, compressor 10, expansion devices 11*a* and 11*b* (which may be provided in the form of valves, metering orifices or other expansion devices), pump 16, liquid-vapor separation device 12, and economizer 14. According to one embodiment, liquid-vapor separation device 12 may be a recirculator vessel. According to other embodiments, liquid-vapor separation device 12 and economizer 14 may one or both provided in the form of single or dual phase cyclonic separators. The foregoing elements may be connected using standard refrigerant tubing in the manner shown in FIGS. 1-5. As used herein, the term "connected to" or "connected via" means connected directly or indirectly, unless otherwise stated. Optional defrost system 18 includes glycol tank 20, glycol pump 22, glycol condenser coils 24 and glycol coils 6*a* and 6*b*, also connected to one-another and the other element of the system using refrigerant tubing according to the arrangement shown in FIG. 1. According to other optional alternative embodiments, hot gas or electric defrost systems may be provided. An evaporator feed pump/recirculator 16 may also be provided to provide the additional energy necessary to force the liquid refrigerant through the evaporator heat exchanger.

Figure 6:
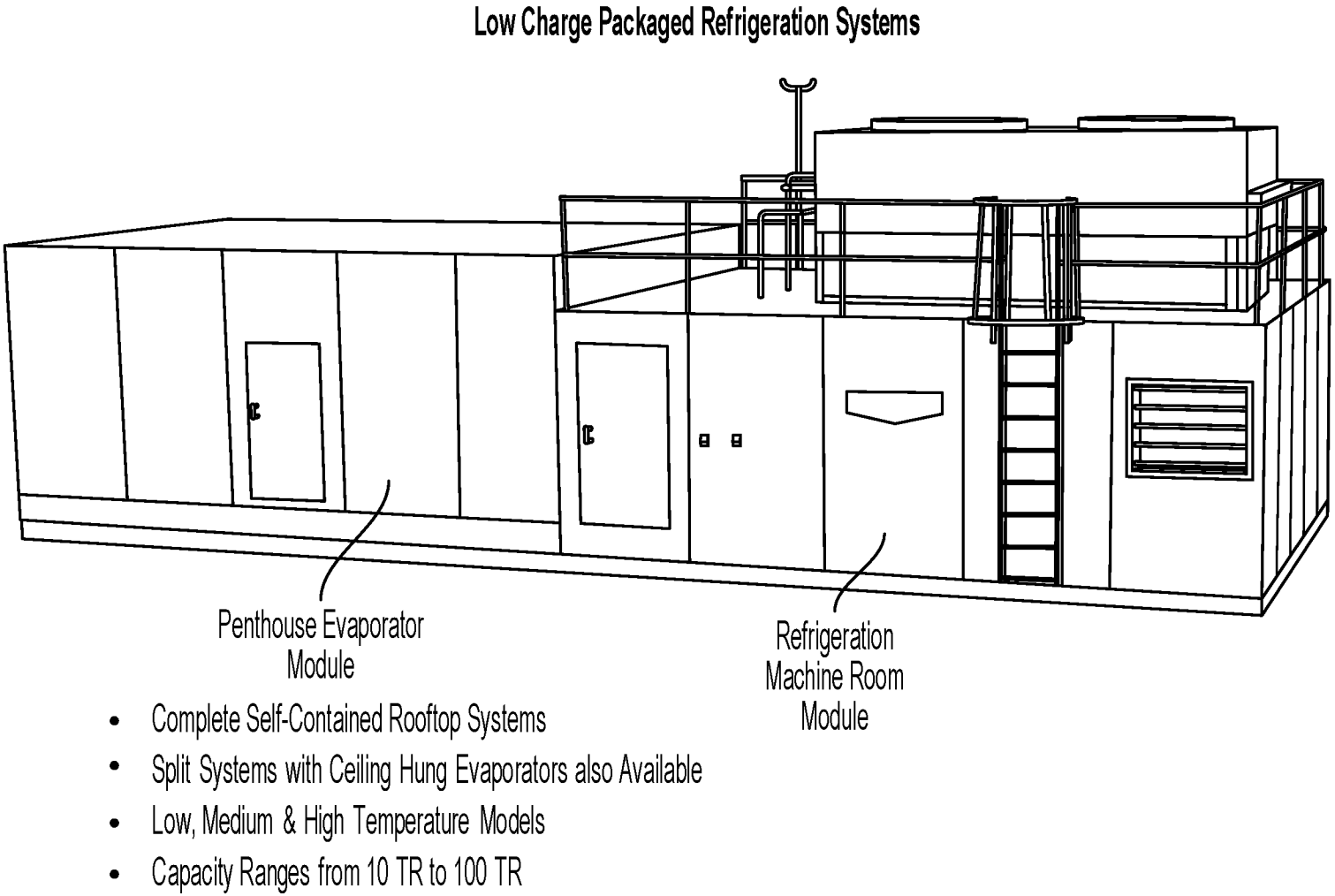
FIG. 6 is a three dimensional perspective view of a combined evaporator module and a prepackaged modular machine room according to an embodiment of the invention.
Figure 7:
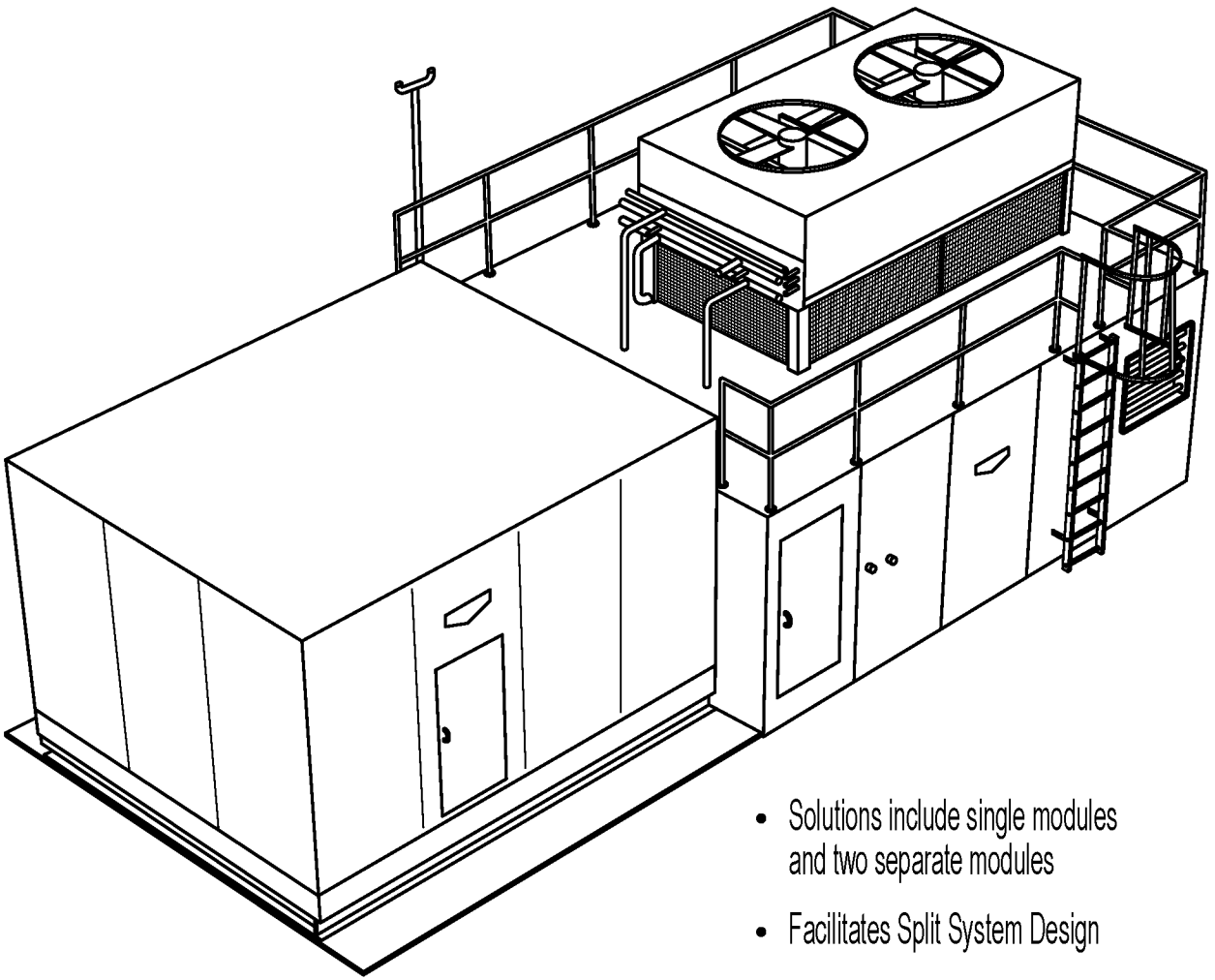
FIG. 7 is a three dimensional perspective view of a combined evaporator module and a prepackaged modular machine room according to another embodiment of the invention.
Figure 10:
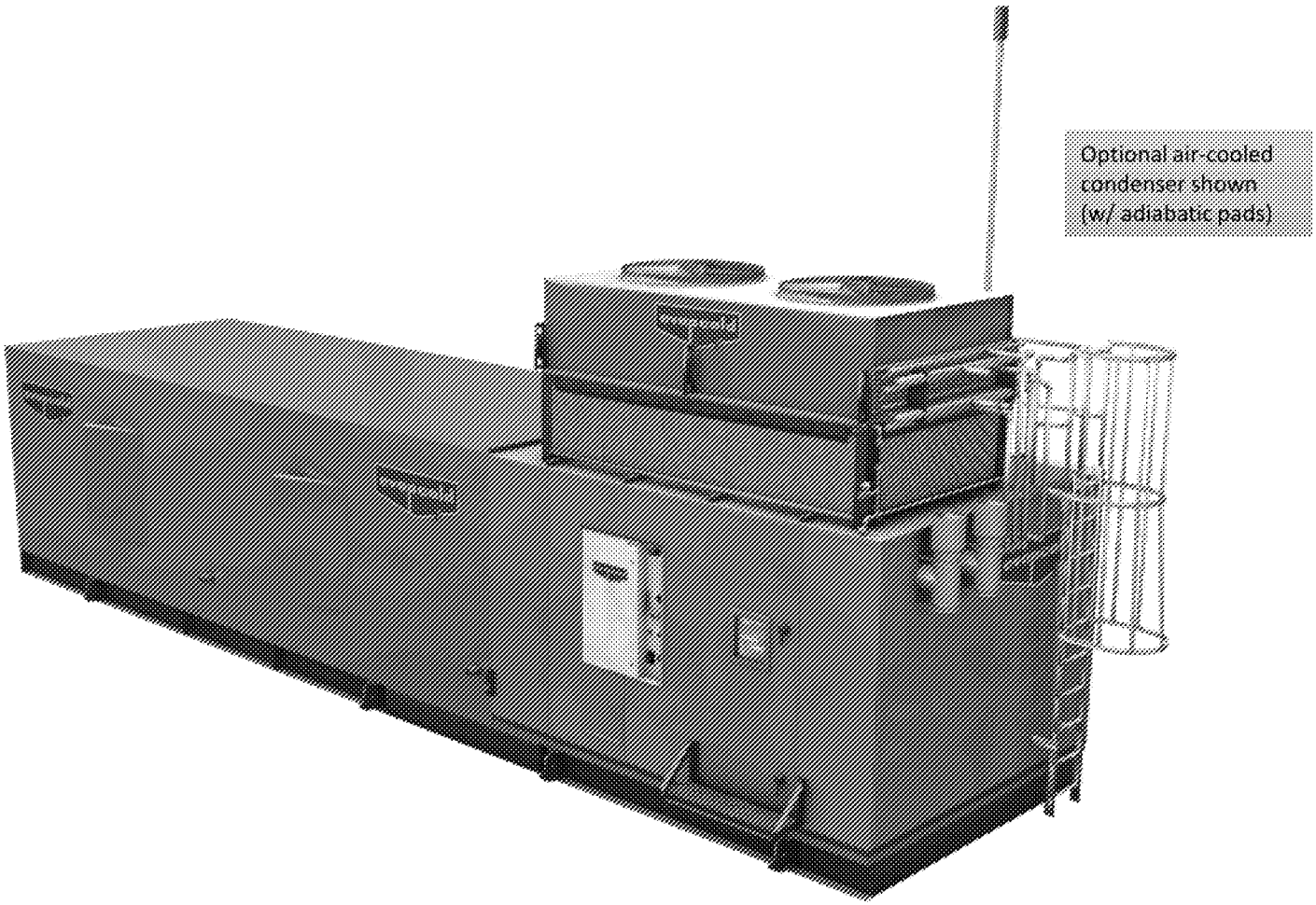
FIG. 10 is a three dimensional perspective view of combined evaporator module and a prepackaged modular machine room according to another embodiment of the invention.
Figure 11B:
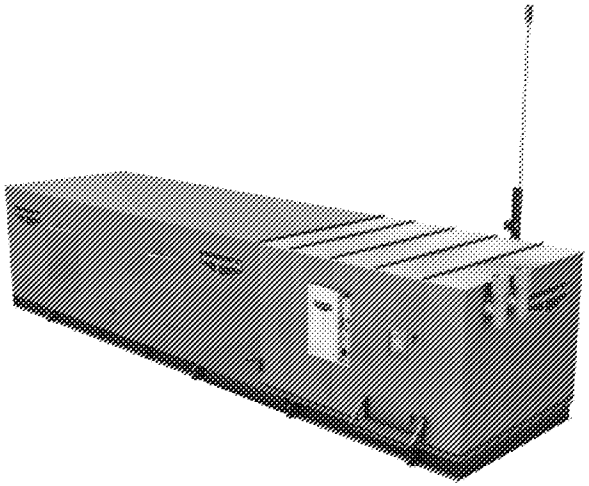
FIG. 11*b* shows a three-dimensional perspective view of another embodiment of a combined evaporator module and prepackaged modular machine room.
Figure 11A:
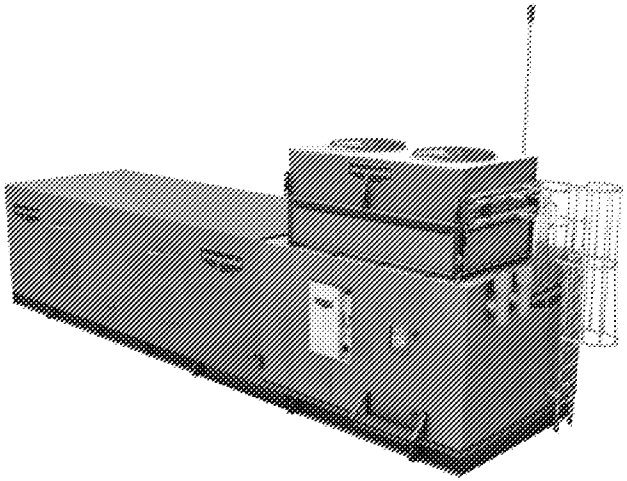
FIG. 11*a* shows a three-dimensional perspective view of one embodiment of a combined evaporator module and a prepackaged modular machine room, which includes a roof mounted air-cooled condenser system.

According to the embodiment shown in FIGS. 1-5, low pressure liquid refrigerant ("LPL") is supplied to the evaporator by pump 16 via expansion devices 11. The refrigerant accepts heat from the refrigerated space, leaves the evaporator as low pressure vapor ("LPV") and liquid and is delivered to the liquid-vapor separation device 12 (which may optionally be a cyclonic separator) which separates the liquid from the vapor. Liquid refrigerant ("LPL") is returned to the pump 16, and the vapor ("LPV") is delivered to the compressor 10 which condenses the vapor and sends high pressure vapor ("HPV") to the condenser 8 which compresses it to high pressure liquid ("HPL"). The high pressure liquid ("HPL") is delivered to the economizer 14 which improves system efficiency by reducing the high pressure liquid ("HPL") to intermediate pressure liquid "IPL" then delivers it to the liquid-vapor separation device 12, which supplies the pump 16 with low pressure liquid refrigerant ("LPL"), completing the refrigerant cycle. The glycol flow path (in the case of optional glycol defrost system) and compressor oil flow path is also shown in FIGS. 1-5, but need not be discussed in more detail here, other than to note that the present low charge packaged refrigeration system may optionally include full defrost and compressor oil recirculation sub-systems within the packaged system. FIGS. 1-5 also include numerous control, isolation, and safety valves, as well as temperature and pressure sensors (a.k.a. indicators or gages) for monitoring and control of the system. In addition, optional sensors 26*a* and 26*b* may be located downstream of said evaporators 2*a* and 2*b*, upstream of the inlet to the liquid-vapor separation device 12, to measure vapor/liquid ratio of refrigerant leaving the evaporators. According to alternative embodiments, optional sensor 26*c* may be located in the refrigerant line between the outlet of the liquid-vapor separation device 12 and the inlet to the compressor 10. Sensors 26*a*, 26*b* and 26*c* may be capacitance sensors of the type disclosed in U.S. Ser. Nos. 14/221,694 and 14/705,781, the disclosures of which are incorporated herein by reference, in their entirety. FIG. 6 shows an example of a combined penthouse evaporator module and a prepackaged modular machine room according to an embodiment of the invention. According to this embodiment, the evaporator is housed in the evaporator module, and the remaining components of the system shown in FIGS. 1-5 are housed in the machine room module. Various embodiments of condenser systems that may be employed according to the invention include evaporative condensers, with optional internally enhanced tubes, air cooled fin and tube heat exchangers with optional internal enhancements, air cooled microchannel heat exchangers, and water cooled heat exchangers. In the case of air cooled condenser systems, the condenser coils and fans may be mounted on top of the machine room module for a complete self-contained rooftop system. Other types of condenser systems may be located inside the machine room. According to this embodiment, the entire system is completely self-contained in two roof-top modules making it very easy for over-the-road transport to the install site, using e.g., flat bed permit load non-escort vehicles. The penthouse and machine room modules can be separated for shipping and/or for final placement, but according to a most preferred embodiment, the penthouse and machine room modules are mounted adjacent to one-another to maximize the reduction in refrigerant charge. According to a most preferred embodiment, the penthouse module and the machine room module are integrated into a single module, although the evaporator space is separated and insulated from the machine room space to comply with industry codes. FIGS. 7, 10 and 11 show other examples of adjacent penthouse evaporator modules and machine room modules.

Figure 8:
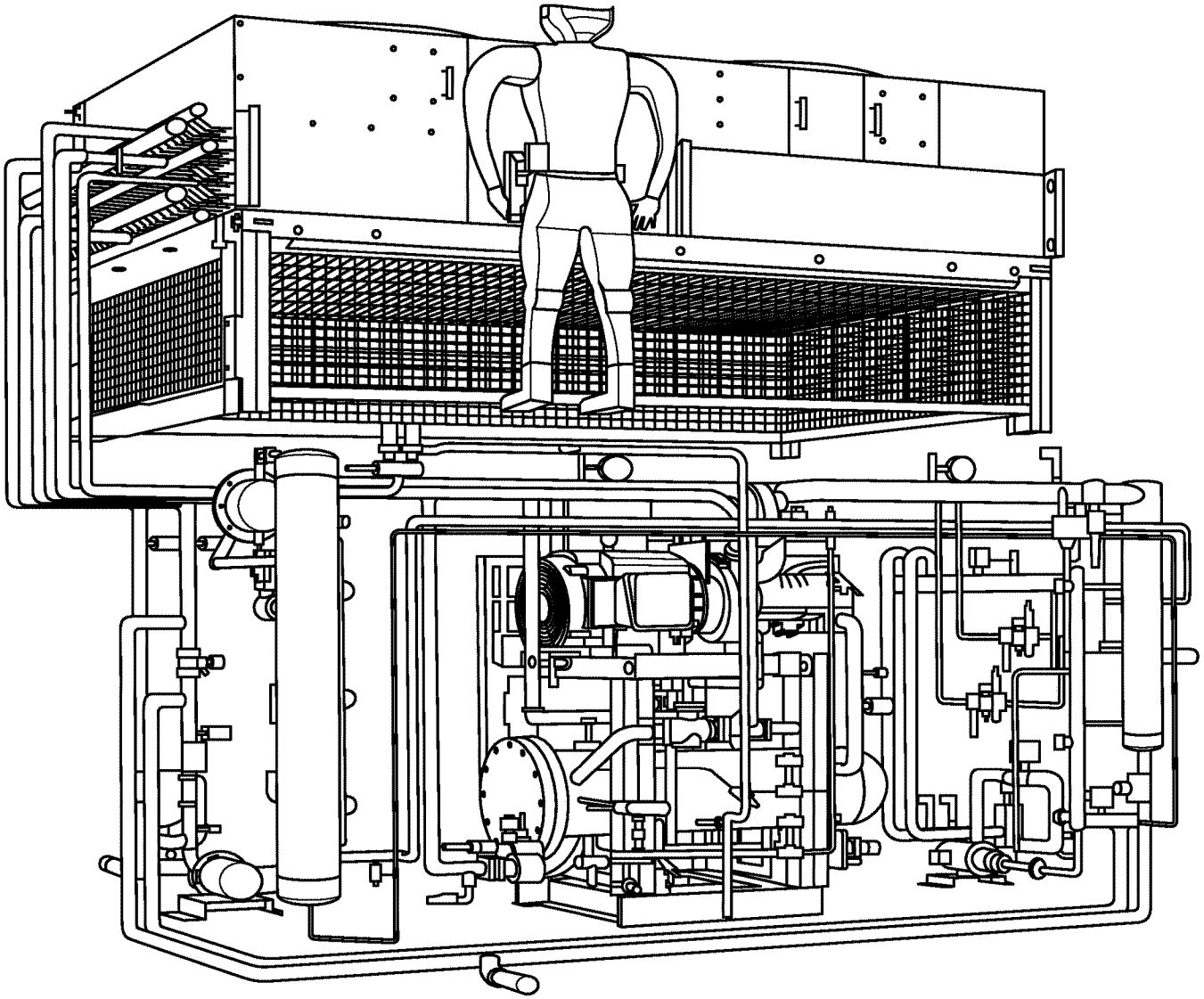
FIG. 8 is a three dimensional perspective view of the inside of a pre-packaged modular machine room and condenser unit according to an embodiment of the invention.
Figure 9:
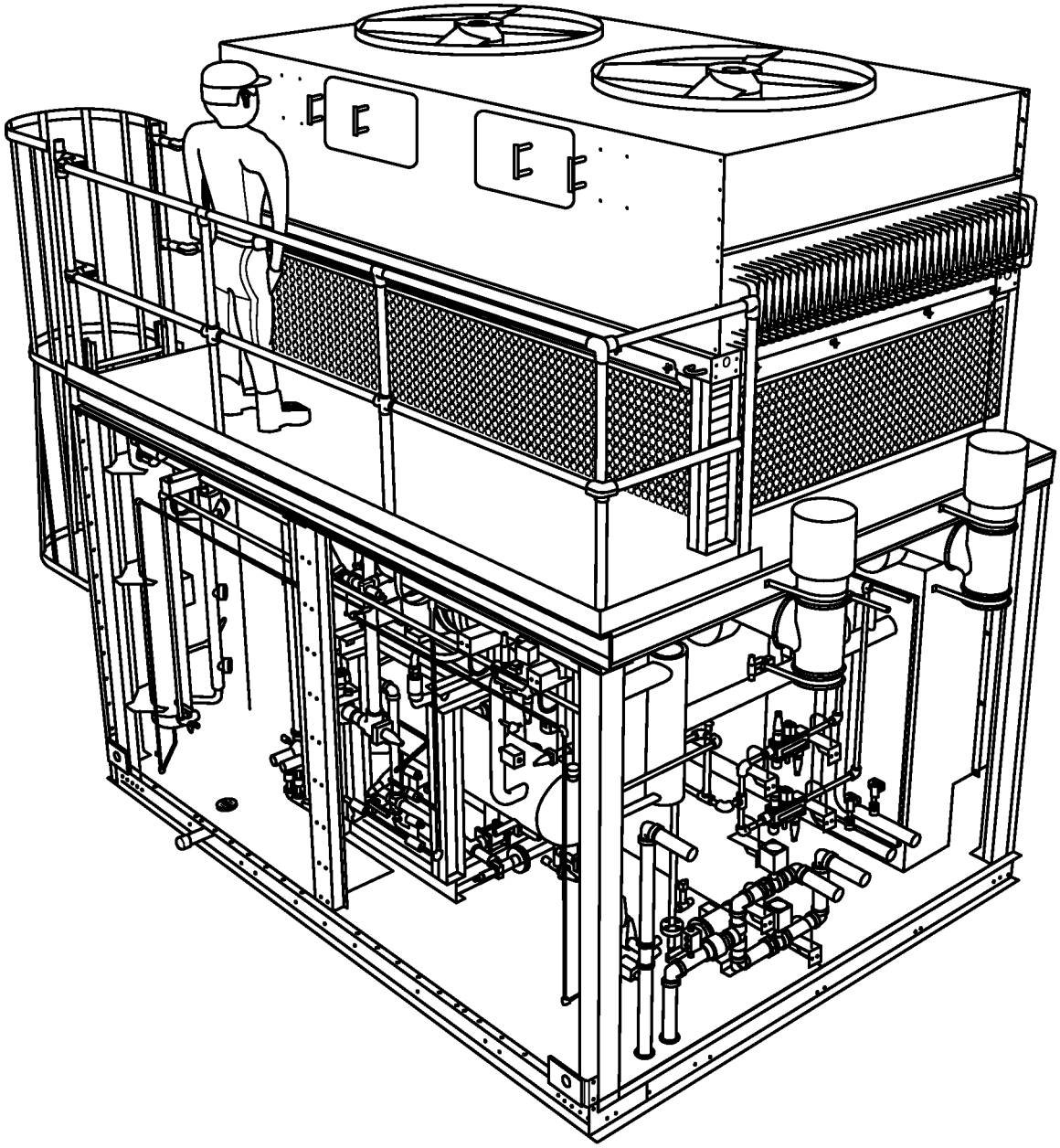
FIG. 9 is a three dimensional perspective view of the inside of a pre-packaged modular machine room and condenser unit according to another embodiment of the invention.
Figure 12:
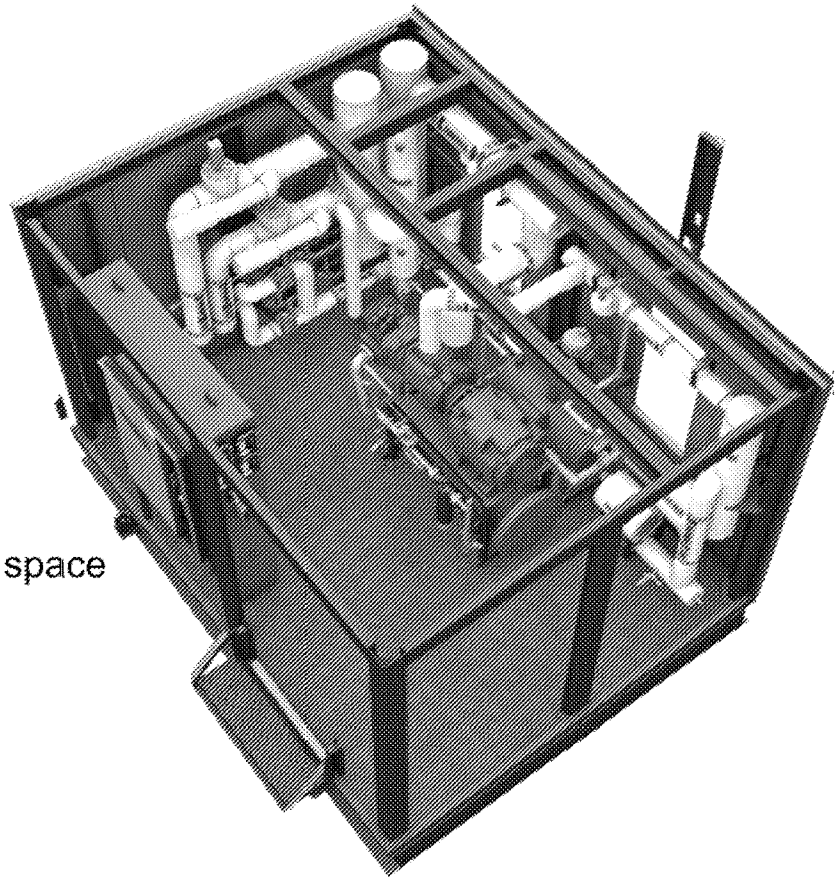
FIG. 12 shows a three-dimensional cut-away view of the inside of a pre-packaged modular machine room according to another embodiment of the invention.

FIGS. 8, 9 and 12 are three dimensional cutaway perspective views of the inside of a pre-packaged modular machine room and condenser unit according to an embodiment of the invention, in which all the elements of the low charge packaged refrigeration system are contained in an integrated unit, except the evaporator. As discussed herein, the evaporator may be housed in a penthouse module, or it may be suspended in the refrigerated space, preferably directly below the location of the machine room module. According to these embodiments, the evaporator is configured to directly cool air which is in or supplied to a refrigerated space.

According to alternative embodiments (e.g., in which end users to not wish refrigerated air to come into contact with ammonia-containing parts/tubing), the evaporator may be configured as a heat exchanger to cool a secondary non-volatile fluid, such as water or a water/glycol mixture, which secondary non-volatile fluid is used to cool the air in a refrigerated space. In such cases, the evaporator may be mounted inside the machine room.

Figure 13:
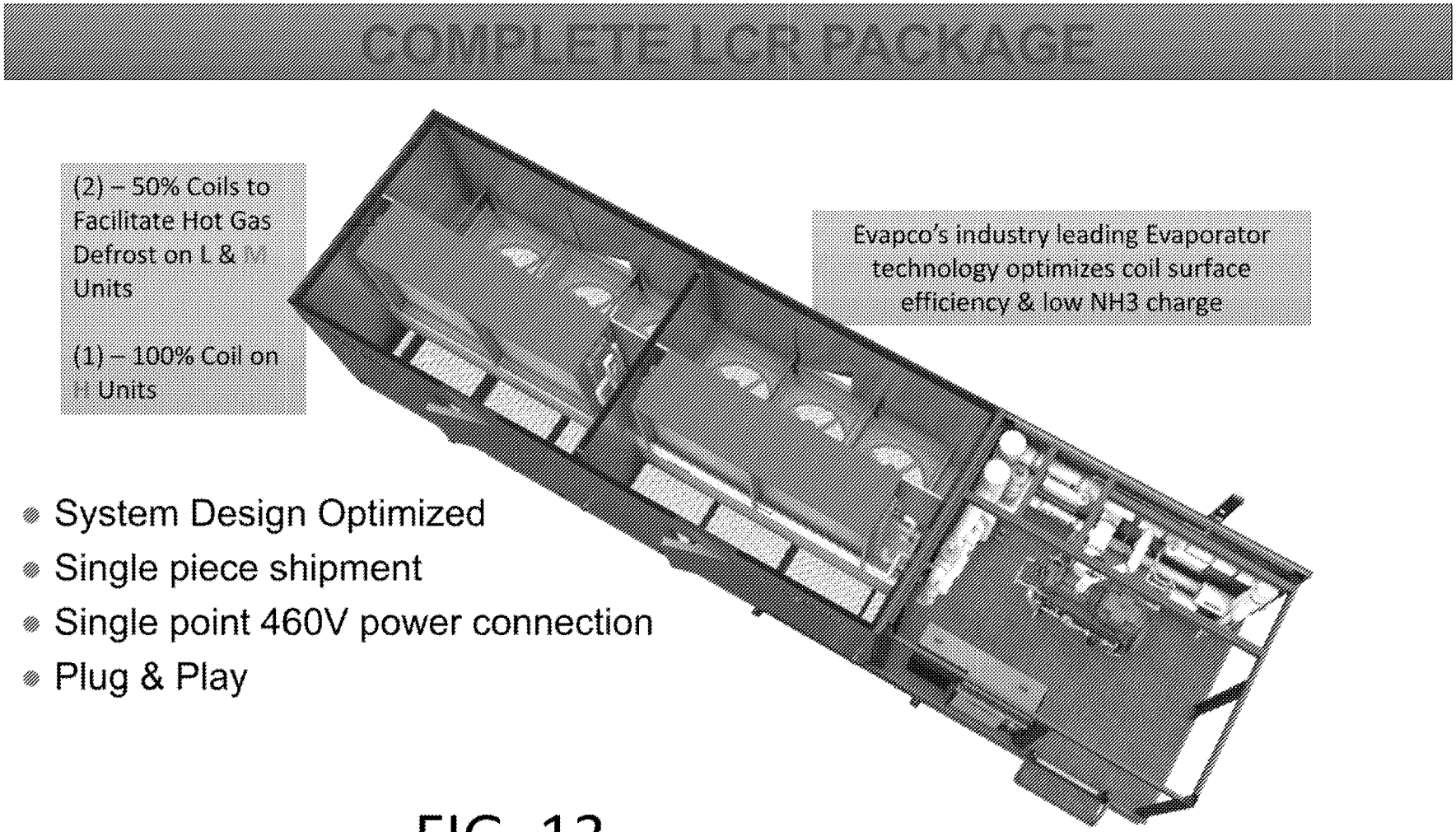
FIG. 13 shows a three-dimensional cut-away view of the inside of a combined penthouse evaporator module and a prepackaged modular machine room.

FIG. 13 is a cutaway three-dimensional perspective view of the inside of a combined penthouse evaporator module and a prepackaged modular machine room.

The combination of features as described herein provides a very low charge refrigeration system compared to the prior art. Specifically, the present invention is configured to require less than six pounds of ammonia per ton of refrigeration capacity. According to a preferred embodiment, the present invention can require less than four pounds of ammonia per ton of refrigeration. And according to most preferred embodiments, the present invention can operate efficiently with less than two pounds per ton of refrigeration capacity. By comparison, prior art "stick-built" systems require 15-25 pounds of ammonia per ton of refrigeration, and prior art low charge systems require approximately 10 pounds per ton of refrigeration. Thus, for a 50 ton refrigeration system, prior art stick built systems require 750-1, 250 pounds of ammonia, prior art low charge systems require approximately 500 pounds of ammonia, and the present invention requires less than 300 pounds of ammonia, and preferably less than 200 pounds of ammonia, and more preferably less than 100 pounds of ammonia, the report threshold for the EPA (assuming all of the ammonia in the system were to leak out. Indeed according to a 50 ton refrigeration system of the present invention, the entire amount of ammonia in the system could be discharged into the surrounding area without significant damage or harm to humans or the environment.

While the present invention has been described primarily in the context of refrigeration systems in which ammonia is the refrigerant, it is contemplated that this invention will have equal application for refrigeration systems using other natural refrigerants, including carbon dioxide.

The description of the invention is merely exemplary in nature and, thus, variations that do not depart from the concept of a packaged (one- or two-module integrated and compact system) low refrigerant charge (i.e., less than 10 lbs of refrigerant per ton of refrigeration capacity) refrigeration system are intended to be within the scope of the invention. Any variations from the specific embodiments described herein but which otherwise constitute a packaged, pumped liquid, recirculating refrigeration system with charges of 10 lbs or less of refrigerant per ton of refrigeration capacity should not be regarded as a departure from the spirit and scope of the invention set forth in the following claims.

Figure 14:
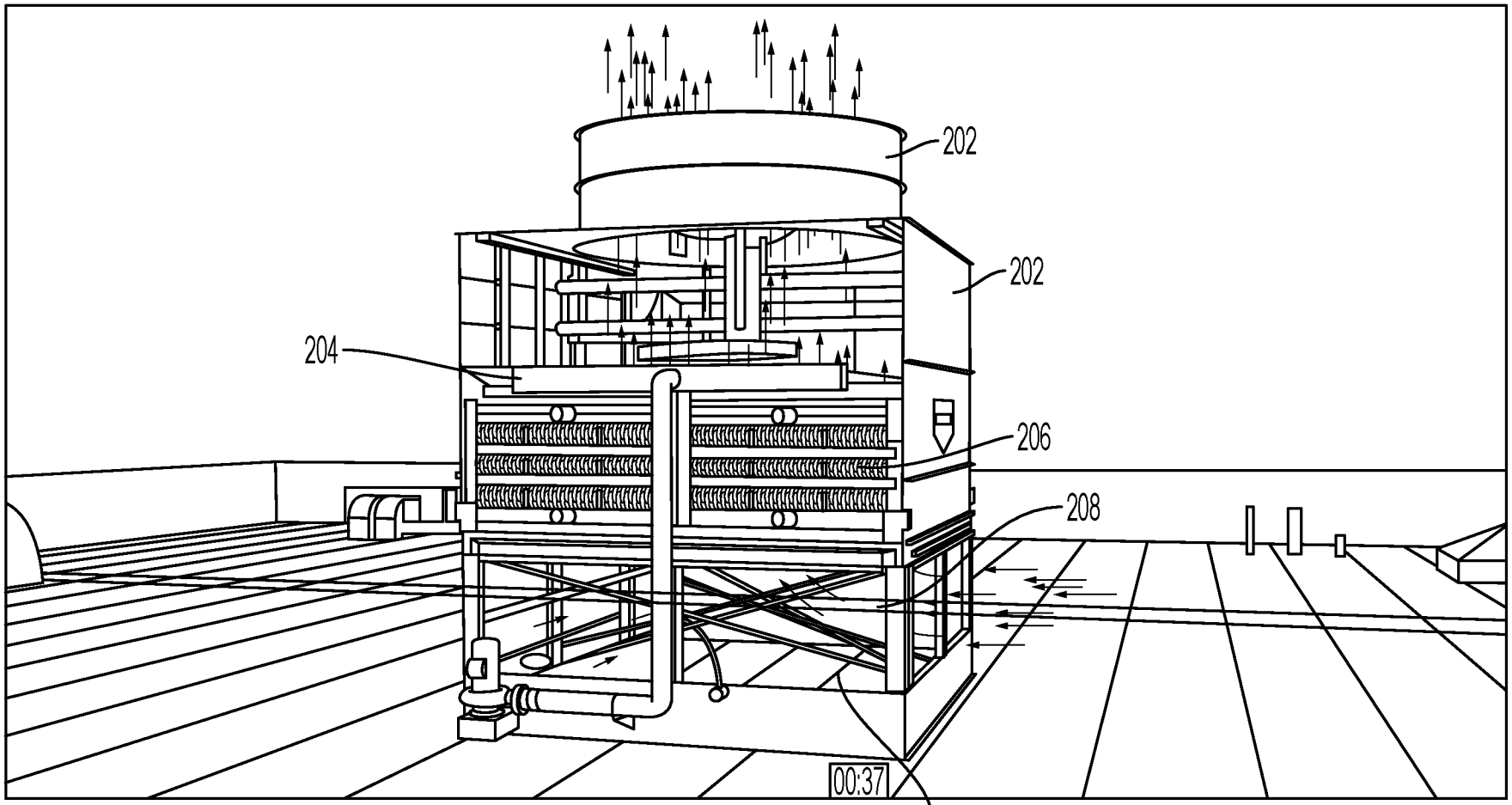
FIG. 14 is a prior art evaporative condenser.

FIG. 14 shows a prior art evaporative condenser unit marketed by Applicant, designated the ATC-E Evaporative Condenser. Housed within the four-sided metal housing 202 of the unit is a water distribution system 204 located above a coil 206 which in turn is located above a plenum 208. The plenum optionally contains fill. At the bottom of the plenum is a water basin 210 where water is collected and pumped to the water distribution system 204. On the top of the unit is an induced-draft fan 212 which pulls air from the outside through openings in the side of the unit adjacent the plenum, up through the coil and out the top of the unit. Process fluid is circulated through the coil and is cooled by evaporative effect of the water and air passing over the coil.

Figure 15:
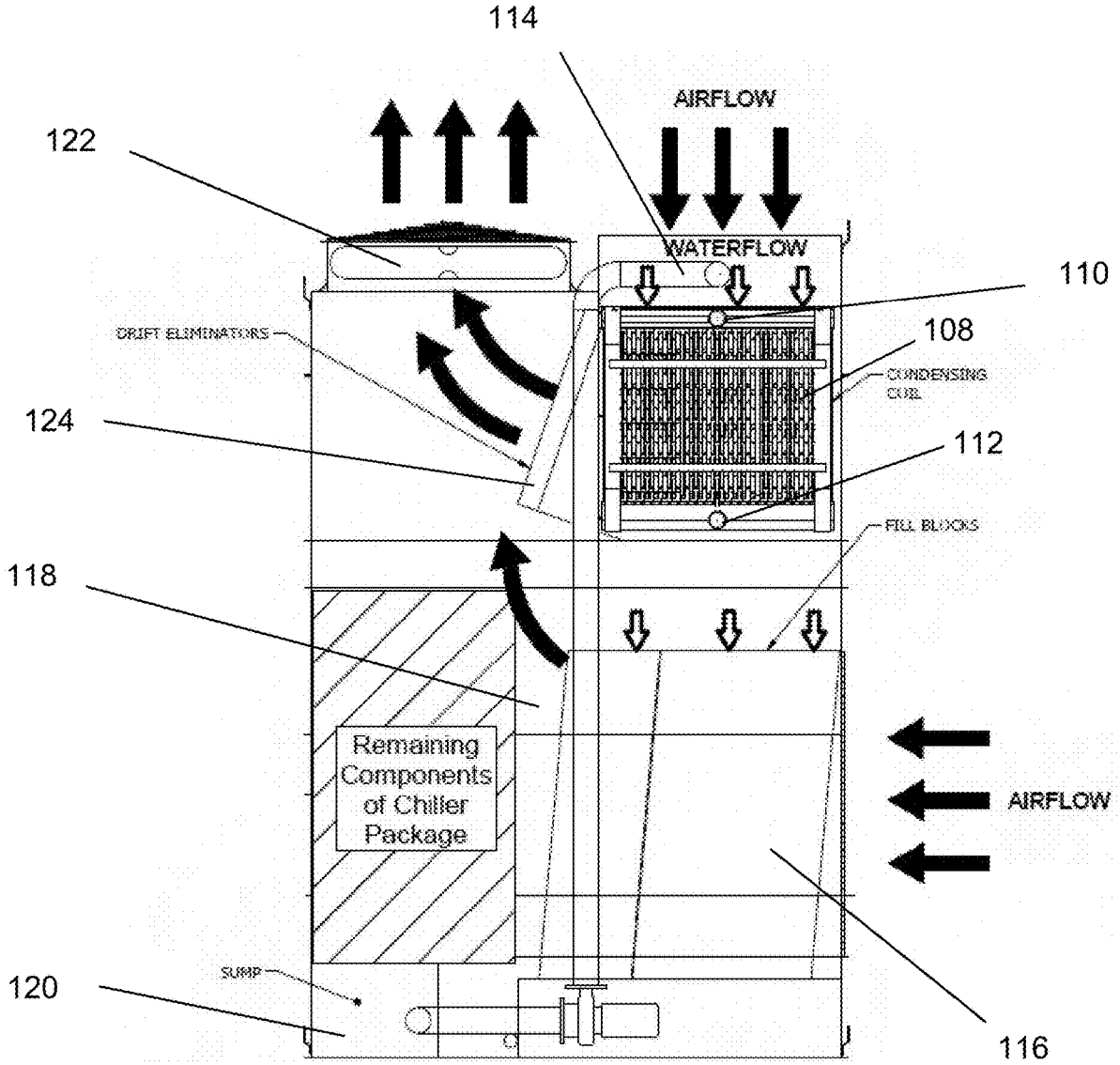
FIG. 15 shows a packaged ammonia evaporative-condensing chiller according to an embodiment of the invention.

FIG. 15 shows an example of an integrated evaporative condensing ammonia chiller package according to an embodiment of the invention, in which the elements of the chiller are packaged in the plenum 118 of an evaporative condenser unit. Examples of evaporative condenser units that may be used or modified for the present invention include, but are not limited to Applicant Evapco, Inc.'s ATC-E models of evaporative condenser. High pressure vapor enters the condensing coil 108 at inlet 110 and exits the coil at outlet 112. Water distribution system 114 sprays water over coil 108, which then falls through fill 116 situated in plenum 118 to collect in sump 120 at the bottom of the unit where it is pumped back through water distribution system. Induced draft fan 122 is located adjacent the water distribution system at the top of the unit and draws air into the system through air inlets located above the water distribution system, and through the side of the unit adjacent fill 116. Air entering the coil 108 exits the coil through the side via drift eliminators 124 and exits through the fan 122 at the top of the unit. Air entering the plenum 108 through the lower side of the unit likewise exits the unit at the top through the fan 122. According to this embodiment, the chiller components of the system shown in FIGS. 1-5 are housed in the plenum of the evaporative condenser component. The evaporator may be located in the refrigerated space or in an evaporator module adjacent the integrated evaporative condensing chiller package.

The invention claimed is:

1. A refrigeration system comprising:

a refrigerant evaporator coil, vapor/liquid separation structure connected to an outlet of said evaporator coil via refrigerant line configured to separate low pressure refrigerant vapor from low pressure refrigerant liquid;

a refrigerant compressor connected to an outlet of said vapor liquid separation structure via refrigerant line and configured to compress refrigerant vapor from said vapor liquid separation structure;

an evaporative refrigerant condenser connected to an outlet of said refrigerant compressor via refrigerant line and configured to condense refrigerant vapor produced in said compressor to refrigerant liquid, a high pressure-side expansion device connected to an outlet of said evaporative refrigerant condenser via refrigerant line and configured to reduce pressure of refrigerant liquid received from said evaporative refrigerant condenser;

a collection vessel connected to an outlet of said high pressure-side expansion device via refrigerant line for receiving refrigerant liquid from said high pressure-side expansion device;

a low pressure-side expansion device connected to an outlet of said collection vessel via refrigerant line and configured to reduce pressure of refrigerant liquid received from said collection vessel;

refrigerant line connecting an outlet of said low pressure-side expansion device to an inlet of said vapor/liquid separation structure and configured to deliver refrigerant liquid to said separation structure;

said vapor/liquid separation structure having a liquid outlet that is connected via refrigerant line to an inlet of said evaporator;

wherein said vapor/liquid separation structure, said compressor, said high pressure side expansion device, said collection vessel, and said low pressure side expansion device are situated inside a plenum of said evaporative refrigerant condenser; and wherein said refrigerant is ammonia.

2. A refrigeration system according to claim 1, which requires less than six pounds of refrigerant per ton of refrigeration capacity.

3. A refrigeration system according to claim 1, wherein said evaporative condenser comprises a water distribution system located above a condenser coil, and said plenum is located beneath and adjacent to said condenser coil.

4. A refrigeration system according to claim 1, wherein said vapor/liquid separation structure comprises a cyclonic separator.

5. A refrigeration system according to claim 1, wherein said vapor/liquid separation structure comprises a recirculator vessel.

6. A refrigeration system according to claim 1, wherein said collection vessel comprises a cyclonic separator.

7. A refrigeration system according to claim 1, wherein said collection vessel comprises an economizer.

8. A refrigeration system according to claim 1, wherein said condenser comprises a microchannel heat exchanger.

9. A refrigeration system according to claim 1, further comprising a liquid to vapor mass ratio sensor situated inside refrigerant line connecting said evaporator coil and said vapor/liquid separation structure.

10. A refrigeration system according to claim 1, further comprising a liquid to vapor mass ratio sensor situated inside refrigerant line connecting said vapor/liquid separation structure and said compressor.

11. A refrigeration system according to claim 1, further comprising an oil separator vessel configured to separate compressor oil from refrigerant vapor received from said compressor.

12. A refrigeration system according to claim 1, which requires less than four pounds of refrigerant per ton of refrigeration capacity.

13. A refrigeration system according to claim 1, which requires less than two pounds of refrigerant per ton of refrigeration capacity.

14. A method for assembling a refrigeration system having a refrigerant evaporator coil, a liquid/vapor separator connected to an outlet of said evaporator coil via refrigerant line configured to separate low pressure refrigerant vapor from low pressure refrigerant liquid, a refrigerant compressor connected to an outlet of said liquid/vapor separator via refrigerant line and configured to compress refrigerant vapor from said liquid/vapor separator, an evaporative refrigerant condenser connected to an outlet of said refrigerant compressor via refrigerant line and configured to condense refrigerant vapor produced in said compressor to refrigerant liquid, a high pressure-side expansion device connected to an outlet of said evaporative refrigerant condenser via refrigerant line and configured to reduce pressure of refrigerant liquid received from said evaporative refrigerant condenser, a collection vessel connected to an outlet of said high pressure-side expansion device via refrigerant line for receiving refrigerant liquid from said high pressure-side expansion device, a low pressure-side expansion device connected to an outlet of said collection vessel via refrigerant line and configured to reduce pressure of refrigerant liquid received from said collection vessel, and said method comprising packaging said refrigerant compressor, said vapor/liquid separator, said high pressure-side expansion device, said collection vessel, and said low pressure-side expansion device in a plenum of said evaporative refrigerant condenser, connecting said refrigerant evaporator coil to said evaporative refrigerant condenser via refrigerant line, and filling said refrigerant system with ammonia refrigerant.

15. A method according to claim 14, wherein said refrigerant evaporator coil is mounted in a modular evaporator room.

16. A method according to claim 15, wherein said modular evaporator room is installed adjacent to said evaporative refrigerant condenser.

17. A method according to claim 14, wherein said refrigerant evaporator coil is mounted in a refrigerated space directly beneath said evaporative refrigerant condenser.

* * * * *